United States Patent [19]

Owens

[11] 4,064,430

[45] Dec. 20, 1977

[54] MULTIPLE LIGHT DEVICE

[76] Inventor: Virgie M. Owens, 605 W. 3rd St., Sweetwater, Tex. 79556

[21] Appl. No.: 708,223

[22] Filed: July 23, 1976

[51] Int. Cl.[2] ..... H05B 33/02; F21S 1/12; F21P 1/02

[52] U.S. Cl. ..... 362/231

[58] Field of Search ..... 240/10 R, 10 A, 10 D, 240/81 A, 84, 25, 11.4 R, 81 R, 51.11 R

[56] References Cited

U.S. PATENT DOCUMENTS

| | | | |
|---|---|---|---|
| 2,146,422 | 2/1939 | Davis | 240/10 R |
| 2,323,172 | 6/1943 | Whittaker | 240/51.11 R |
| 2,355,467 | 8/1944 | Proulx | 240/51.11 R X |
| 2,364,854 | 12/1944 | Kallman | 240/81 R X |
| 3,388,245 | 6/1968 | Larsen | 240/10 R X |
| 3,610,919 | 10/1971 | Winpisinger et al. | 240/84 X |
| 3,767,904 | 10/1973 | Cook | 240/51.11 R X |
| 3,968,359 | 7/1976 | Shaffer | 240/10 R X |

FOREIGN PATENT DOCUMENTS

| | | | |
|---|---|---|---|
| 943,480 | 5/1956 | Germany | 240/25 |
| 944,446 | 12/1963 | United Kingdom | 240/10 A |

*Primary Examiner*—Donald A. Griffin

*Attorney, Agent, or Firm*—Clarence A. O'Brien; Harvey B. Jacobson

[57] ABSTRACT

A multiple light device for displaying a shower of colors includes a plurality of neon light sets supported between a top flared cover member and a bottom support member both of which are mounted upon a support pole which may be mounted in the ground or the like. A blue neon, a white neon, and a red neon bulb are included in each plurality of light sets which are in turn covered by a transparent outer protective tube. The top flared cover is removable for replacement of the individual tubes and lights. The electrical wiring and transformer circuitry for the neon bulbs are included within the center support tube and the base support member. Appropriate breaker or flasher members are provided for each of the individual neon tubes so they will turn on and off automatically. The overall effect is that of a shower of light, i.e. the topmost bulbs will turn on first, then the intermediate bulbs will turn on secondly with the top bulbs bulbs turning off, and then lastly the bottom bulbs will turn on while the intermediate bulbs turn off. The overall effect is that of a descending shower of light. Provision is also made for an electronic eye to be installed in the top cover panel for automatically turning on the overall device at sundown and off at dawn.

7 Claims, 3 Drawing Figures

MULTIPLE LIGHT DEVICE

BACKGROUND OF THE INVENTION

1. Field of the Invention

This invention relates generally to lights for display and attention getting purposes and specifically to a light having the bicentennial colors of blue, white and red, which are mounted and appropriately connected electrically to turn on and off in a manner which will give a shower-like effect.

2. Description of the Prior Art

A common problem with known type multiple light devices is that they do not have the desired attention and attraction gaining performance which is desired with such lights.

Another problem with lights having different colors is that they normally are all turned on simultaneously and merely display the different colors simultaneously, and/or they turn the colors on and off simultaneously or in a random pattern without creating any special effect.

Another problem with known devices are that they are not easily changeable or replaceable with new bulbs or elements when failures or defects occur in the existing ones.

Another problem is that unless someone turns the overall lighting device on or off at dusk and dawn, the lights will operate continuously which is expensive and unpatriotic in these days of electric conservation.

Known prior art patents which may be pertinent to this invention are as follows: U.S. Pat. Nos. 602,966; 1,849,552; 2,323,172; 2,355,467; 2,364,854; 2,429,850; 2,907,868; 2,976,399.

None of these known prior art devices offers the new and unique features of the invention disclosed herein.

SUMMARY OF THE INVENTION

An object of the present invention is to provide a multiple light device which is unique in the manner of operation in that the overall effect produced by the light is one of a shower of light. This is effected by the top portion of the overall light device turning on, then the intermediate portion turning on while the top portion turns off, and then the bottom portion turning on while the intermediate portion turns off. The process then repeats itself with the bottom portion turning off when the upper portion turns on again. If the first, second and third described portions are of different colors, for example, blue on the top, white in the middle, and red on the bottom, a very attractive and desirable bicentennial effect will be produced.

Another object of the present invention is to provide a multiple light device which is easily maintained, relatively easy to replace individual lights as they become defective, and yet offers a safe, attractive, overall struture which will withstand the outside elements.

Another object of this invention is to provide a light device having bottom and top mounting structures for a plurality of tubular light members, said light members being enclosed within transparent plexiglass outer protective tubes, and said inner lights being of the neon type of different colors. Each light is provided with an individual circuit breaker or flasher so connected as to energize/deenergize the respective lights in a repetitive manner.

A still further object of this invention is to provide a multiple light device wherein all of the electrical components are contained within the structure out of exposure to the weather and also include an electric eye device for the purpose of automatically turning the overall fixture on at dusk and off at dawn.

The multiple light device of this invention has a number of very important features. It is mounted upon a central support pole and has a top flared cover member supported from the top of said pole in a removable manner. The flared top cover member supports one end of the sets of individual protective light tubes with a lower support member appropriately mounted on the central support tube a predetermined distance therebelow for supporting the lower ends of said light sets. The distance of the individual support members for the bottom portion of the light sets is much closer to the central tube than the distance of the top sets which will give a slanted or tapered effect to the overall light output. This will cause the light emitted from the individual light sets to be radiated outwardly in a downward manner.

Another important feature of this device is in the overall light effect achieved thereby. Because of the unique arrangement of the individual neon lights within each protective light tube set, the effect to the viewer is that of a shower of light. This is achieved by having lights in the upper portions of the protective tubes all of one color, lights in the center portions of the individual tube sets of another color, and lights in the bottom portions of the individual tube sets of a third color. The individual lights are connected electrically with flashing breaker members which will individually energize said lights in a repetitive fashion and in a predetermined manner. This predetermined manner consists of turning on the first upper set of lights with the other sets being off, then turning on the next set, for example, the middle set and shortly thereafter turning off the upper set, and then turning on the lower set, while turning off the middle set. If the respective colors of these three sets are, for example, blue at the top, white in the middle, and red at the bottom, a very attractive and unique bicentenial effect and shower of light effect will be achieved. Each set of lights are covered by a plexiglass protective tube for overall protection thereof and to allow complete visibility of the lights themselves while giving adequate protection to same, and also protecting and supporting the multiplicity of electrical flasher breakers as associated with the energization hookup and the lights themselves.

Another feature of this invention is in the inclusion of a photo cell on the top removable cover member which will as appropriately hooked into the electrical circuitry, turn on the overall light device at dusk, and turn off the overall light device at dawn. This permits the device to be installed in shopping centers, restaurants, motels, and other facilities where individual attention to the light device might not easily be available each and every day.

The mounting of the protective tubes containing the sets of illuminating neon bulbs also is unique in that cup-like receptacles are provided on the inside of the flared top of a member for engaging the upper ends of the protective light tubes while similar cup receptacles ar provided on the upper outside portion of the lower support member for reception of the bottom end of the light protective tubes. This simple but sufficient support structure permits quick and easy replacements of individual light structures if a defect should occur in same. It is merely necessary to remove one center nut at the top of the overall light and support therefor, then remove the flared top cover member and the entire set of light structures are readily available for changing, etc.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
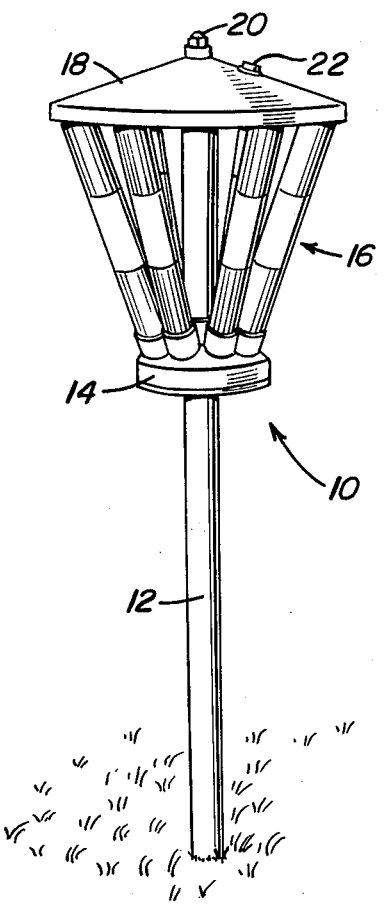
FIG. 1 is a perspective view of the multiple light device of this invention.
Figure 2:
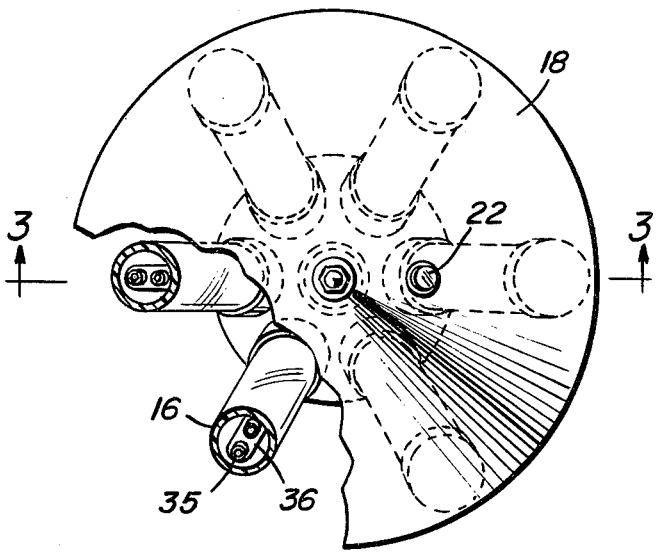
FIG. 2 is a top plan view, partly broken away and partly in cross section, of the multiple light device.

Referring to FIG. 1 of the drawings, reference numeral 10 indicates in general the multiple light device of this invention. Mounted in the ground or other appropriate support surface is a member 12 of tubular construction. Mounted upon this support post or pole is a base member 14 for supporting the plurality of light structures 16 and a top flared cover member 18. This cover member 18 is removably mounted by means of an attractive flared nut 20 as seen in greater detail in FIG. 3. Also mounted on the flared cover member 18 for access to the visible outside light is a photoelectric cell or electric eye 22.

Looking at FIG. 3 of the drawings, the detailed construction features will be described. Depending from the outer edge of the flared cover member 18 is a flange 19. This flange offers protection to the upper portions of the light sets as will be described below. Mounted within the upper cover and closely adjacent to the flange 19 are individual cup receptacles 30 appropriately fastened by welding, epoxy, and the like to the cover member. These cup receptacles form the upper support points for the light tubes 16. Similar lower cup receptacles 32 are appropriately provided on the lower support member 14 and are directly fastened to the tapered panel 15 which has a taper at an angle closely similar to the flare of the top cover. Thus the cup receptacles 30, 32 will be substantially perpendicular to the light devices 16 as they support same.

The support member 14 has a base plate 17 with a central aperture therein which slidably fits over and engages with the center support post 12. The panel member 15 has an extruded flange portion at the center thereof 15' for close engagement with the center support tube 12. This extruded portion 15' may be appropriately fastened by set screws, not shown, or similar fastening devices to the center support post. A special center recessed washer 26 with a central aperture therein fits over the top opening of the cover 18 for reception of the retaining stud 25 which is mounted in the top of post 12 by means of a top fixture member 13. The washer member 26 may be of semi-resilient material to effectively form a water tight blocking member at the top of the light device. As can be readily visualized when the nut 20 is tightened, the semi-resilient member 26 will appropriately deform to securely close any openings present at this point and thereby effect a completely water tight top enclosure.

Figure 3:
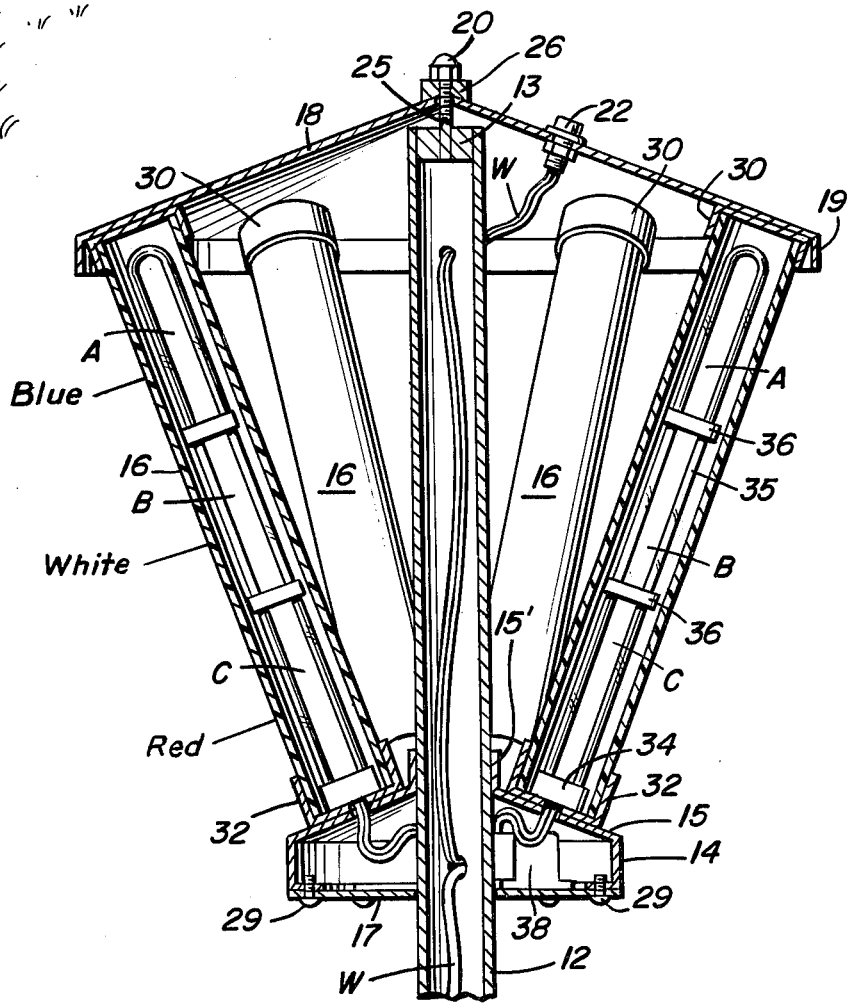
FIG. 3 is a side elevational view, partly in cross section, taken generally along line 3—3 of FIG. 2.

As can also readily be seen from FIG. 1 and FIG. 3, the lower cup 32 receptacles are much closer to the center support tube 12 than the upper cup receptacles 30, which provides an overall upwardly and outwardly tapered effect to the light. This also effects an illumination of surrounding areas outwardly and downwardly from the multiple light sets 16.

The protective transparent tubes 16 are preferable made of plexiglass or other break resistant yet transparent material. Mounted within each of the lights 16 are a plurality of individual neon bulbs 35 appropriately indicated as A, B, and C in FIG. 3. Interconnecting the sets of lights A, B and C are flasher breakers 36. These flasher breakers 36 are hooked to the supply wires 34 in a conventional manner. Also, an electric eye 22 may be appropriately connected by the electric wires W so as to effectively turn on the overall light device at dusk and turn it off at dawn. Again, this eye would be hooked in series with the electric supply wiring and the wiring to the flashing breakers 34 according to approved elecric code wiring requirements.

As shown, the preferred manner of constructing this device is to provide the light set A all of one color such as blue, the middle light set B of another color or in the example shown white, and the lower set of a third color as in the example shown red. The neon bulbs 35 of each respective set will then, when appropriately energized from the supply wiring, and the flashing breakers 36 as closed, turn on the respective light sets in a repetivitive sequence manner. That is, the top set of blue lights will turn on first, then as the top lights are turned off the middle set will turn on, and as the middle set are turned off the bottom lower set are turned on, and then as the bottom set are turned off the upper set again turned on. This sequential repetitive manner, and especially with the blue, white and red arrangement will produce a very attractive bicentennial shower of light effect. Connected with the lights and associated wiring W are appropriate neon transformers and starters 38 as is conventional with neon bulbs. Mounting screws 29 fasten the plate 17 and the member 14, 15 together and permits access to the wiring and components when necessary.

As can be readily visualized by looking at the drawings, this multiple light device will produce a very attractive and unique effect and will be very, very useful for attention getting purposes.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A multiple light device for displaying a shower of light effect comprising; a main support means, and light means on the main support means for emitting colored illumination in a repetitive and sequential manner in order to create the shower of light effect, the light means including a plurality of sets of light emitting devices of different colors mounted together in a single transparent protective tube structure, and the series of light devices being connected to associated electrical operating means for the purpose of creating the repetitive sequential operation thereof, with the light means for creating the repetitive sequential operation of the light emitting device including a plurality of flasher breakers, a like number of flasher breakers as bulbs, and each of the flasher breakers connected to a respective one of the bulbs for alternating the breakers and bulbs within an associated one the tubes.

2. The structure as set forth in claim 1, wherein a plurality of sets of these protective transparent tube structures are mounted around the support means in a diverging arrangement so as to cast the illumination outwardly and downwardly.

3. The structure as set forth in claim 2, wherein the support means includes a tubular pole member, a bottom panel member supported near the upper part of said pole member, and a tapering flange cover member mounted on the top of said pole.

4. The structure as set forth in claim 3, wherein the light emitting devices are of the neon bulb type, and an appropriate neon transformer, starter, and connecting wiring are mounted on the lower support panel.

5. The structure as set forth in claim 4, together with an electric eye electrically connected in the circuit and mounted on the tapering flange top cover member for the purpose of turning the overall device on at dusk and off at dawn.

6. The structure as set forth in claim 5, wherein the protective tubes are of plexiglass material, and are supported by the top cover member and the main bottom member by cylindrical cup receptacles.

7. The structure as set forth in claim 6, wherein the top flange cover member is mounted for quick and easy removal from the pole by means of a water tight connection for the purpose of easily changing individual neon bulbs when they become defective.

* * * * *